United States Patent [19]

Wörz

[11] 4,048,972

[45] Sept. 20, 1977

[54] IGNITION COIL FOR INTERNAL COMBUSTION ENGINES

[75] Inventor: Paul Wörz, Schwieberdingen, Germany

[73] Assignee: Robert Bosch GmbH, Stuttgart, Germany

[21] Appl. No.: 618,556

[22] Filed: Oct. 1, 1975

[30] Foreign Application Priority Data

Oct. 12, 1974 Germany ..... 2448768

[51] Int. Cl.[2] ..... F02P 7/00

[52] U.S. Cl. ..... 123/148 D; 336/96; 336/160

[58] Field of Search ..... 123/148 D; 336/69, 160, 336/228

[56] References Cited

U.S. PATENT DOCUMENTS

| | | | |
|---|---|---|---|
| 1,159,226 | 11/1915 | Johannesen | 336/160 |
| 2,081,979 | 6/1937 | Bentley | 123/148 D |
| 2,850,708 | 9/1958 | Antalis | 336/160 X |
| 3,617,966 | 11/1971 | Trench | 336/96 X |
| 3,795,236 | 3/1974 | Jukes | 336/96 X |
| 3,949,338 | 4/1976 | Burson | 336/96 X |

*Primary Examiner*—Harold W. Weakley
*Attorney, Agent, or Firm*—Flynn & Frishauf

[57] ABSTRACT

To provide a sharply rising flank of the ignition pulse, an insert of ferromagnetic material is placed between the primary and secondary coils of the primary and secondary windings of the ignition coil, forming a magnetic shunt to the core, and modifying the wave form of the output pulse from the ignition coil upon sudden interruption of current flow therethrough.

11 Claims, 6 Drawing Figures

FIG. 1a
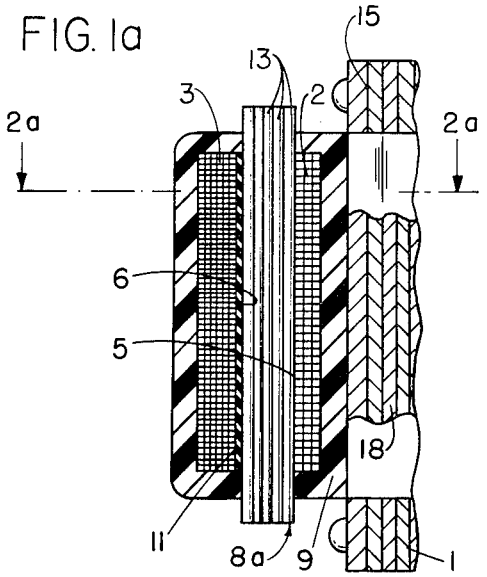
FIG. 1b
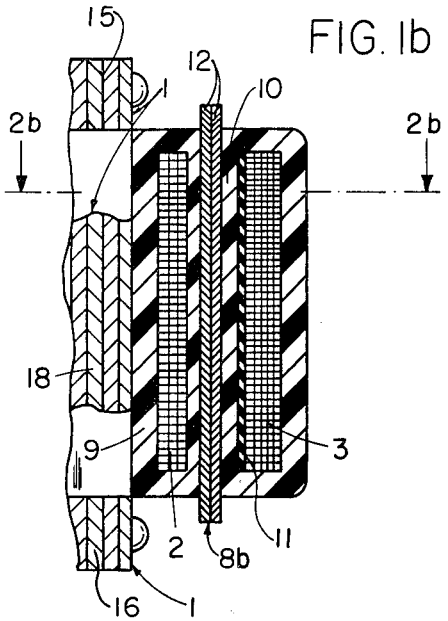
FIG. 2c
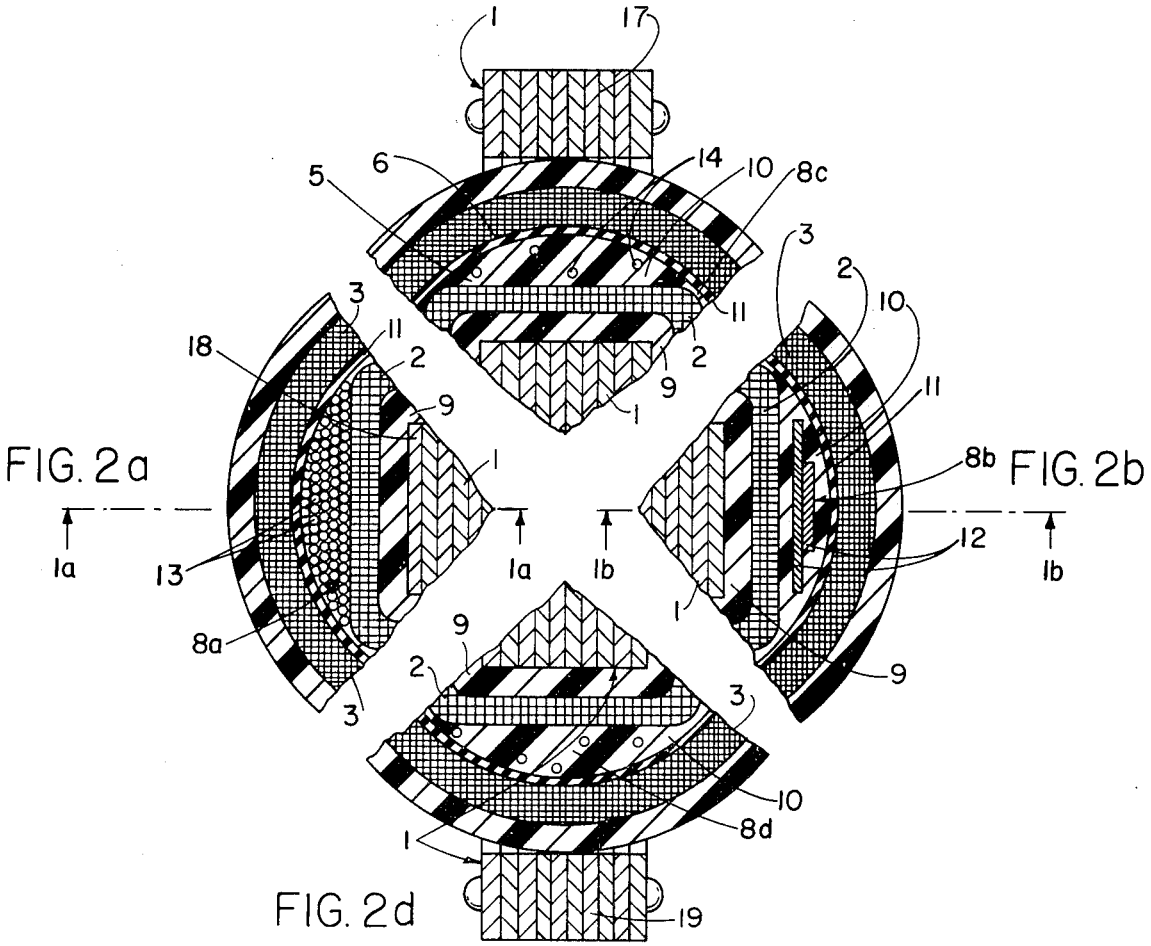
FIG. 2d

IGNITION COIL FOR INTERNAL COMBUSTION ENGINES

The present invention relates to ignition coils for internal combustion engines and more particularly to such coils in which a primary winding surrounds an iron core, and a secondary winding surrounds the same iron core, preferably located outside of the primary winding, and concentric therewith.

Internal combustion engines using externally generated ignition by means of sparks plugs usually use ignition coils, primarily due to the simplicity of the system. The rising flank of the output pulse provided by the ignition coil, upon sudden interruption of current flow through the primary, may not always be steep enough to ignite the combustible mixture in the cylinder of the internal combustion engine if soot, carbon deposits, or other contaminants are located on the insulating body of the spark plug to form a comparatively low resistance creep path.

It is an object of the present invention to provide an ignition coil which delivers an output pulse having improved wave form with respect to flash-over, or sparking of the spark plug, that is, which provides an output pulse having a steep rising flank.

SUBJECT MATTER OF THE PRESENT INVENTION

Briefly, an insert of magnetically conductive material is located in the space between the primary and secondary windings, forming a magnetic shunt with respect to the iron core of the ignition coil.

The magnetic leakage flux is thus matched to the main magnetic flux in such a manner that the resulting output pulse delivered by the ignition coil has a steeply rising flank. The wave form of the output pulse is thus modified by the magnetic insert.

The invention will be described by way of example with reference to the accompanying drawings, wherein:

FIG. 1*a* is a vertical sectional view taken along line I—I of FIG. 2*a* and illustrating a half-core, the other half being its mirror image;

FIG. 1*b* is a vertical cross-sectional view along line I—I of FIG. 2*b* and illustrating a half core of another embodiment, the other half being its mirror image;

FIG. 2*a* is a fragmentary horizontal sectional view taken through line II—II of FIG. 1*a;*

FIG. 2*b* is a fragmentary vertical cross-sectional view taken along line II—II of FIG. 1*b;* and FIGS. 2*c* and 2*d*, being mirror images of each other, are horizontal cross-sectional views along lines II—II of either of FIGS. 1*a*, 1*b*, and illustrating the portions in front of and behind the respective half-core sections of FIGS. 1*a*, 1*b*. *FIGS. 1a* and 1*b*, taken together, illustrate a general arrangement of an ignition coil, the difference being in the particular arrangement or embodiment of the magnetic inserts 8*a*, 8*b*, 8*c;* FIGS. 2*a*, 2*b*, 2*c* and 2*d* are a general transverse sectional view of an ignition coid of FIGS. 1*a*, 1*b*, and illustrating, respectively, different embodiments of the magnetic inserts 8*a*, 8*b*, 8*c*, 8*d*. The Figures are drawn together for better visualization of the overall structure of the ignition coil. Chain-dotted lines A, B, C separate the figures.

The ignition coil is adapted for cooperation with the ignition system (not shown) of an internal combustion engine (not shown). A central iron core 1, which preferably is laminated, is surrounded by a primary winding 2.

A secondary winding 3 in turn surrounds the primary winding 2. These windings are shown but once in the respective Figures. The primary winding 2 and the secondary winding 3 are bounded, respectively, by boundary surfaces 5, 6, which include a space or void therebetween. An insert of magnetically conductive material is located in that space. This insert is shown at 8*a*, 8*b*, 8*c*, 8*d*, respectively, and forms a magnetic shunt with respect to iron core 1. The iron shunt insert preferably is soft iron. The magnetic leakage flux can be so matched or tuned to the main magnetic flux that the rising flank of the ignition pulse delivered by the secondary winding of the ignition coil has optimum steepness.

The cross section of iron core 1 is square. The primary winding 2, in a preferred form, is a square coil surrounding iron core 1 in the form of a hollow coil of approximately square cross section, and wound on an insulating sleeve or form 9. The secondary winding 3, which in the embodiment shown surrounds the primary winding 2, is would as a cylindrical coil. the space 10 between the two coils formed by the windings 2, 3 then will be sector-shaped, which is an optimum shape to locate the insert of soft iron magnetic material therein. The secondary coil is wound on an insulating sleeve or support or coil form 11.

The magnetic insert 8*b*, in one form of the invention, is formed by a plurality of longitudinal strips 12 (FIGS. 1*b*, 2*b*) the width of which decreases as the strips 12 are located farther and farther away from the center of the coil. The iron inserts will easily match the space within which they are located. The strips 12 can be located in one or more of the sector spaced 10.

The inserts may have various forms; for example, and as shown in FIGS. 1*a*, 2*a*, one or more wires 13 may be used; preferably, a bundle of individual wire inserts (FIGS. 1*a*, 2*a*) is placed in the respective space 10 to essentially entirely fill the space between the limiting surfaces 5, 6 of the coils forming the primary and secondary windings.

The inserts 8*a*, 8*b*, that is, strips 12 or wires 13 preferably are made longer than the length of the coils so that the ends extend over the facing edges of the coils of windings 2, 3, as seen in FIGS. 1*a*, 1*b*. The ends of the strips or wires, respectively, can be bent inwardly or outwardly to further correct the flux relationship of the magnetic circuit. Extending the inserts above the edges of the coils further improves heat dissipation from the coil.

Rather than making the inserts as separate elements, particles 14 embedded in plastic potting compound can be used, as seen in FIGS. 2*c*, 2*d*. the inserts 8*c*, 8 *d* include a standard potting compound, such as epoxy resin, or the like, in which soft iron particles or magnetic particles having soft iron characteristics are embedded. This embodiment is particularly simple if the entire coil is potted, that is, if all voids are filled with a suitable potting compound, to form a single, unitary, wholly encapsulated unit, as shown also in connection with FIGS. 2*a*, 2 *b*, in which potting compound surrounds the respective strips 12 or wires 13.

The magnetic circuit is particularly suitable if the core 1 has three legs 17, 18, 19, located between return yoke portions 15, 16. The center leg 18 may include an air gap. In a preferred form, windings 2, 3 surround the center leg, as shown in the drawings.

Various changes and modifications may be made and features described in connection with any one of the embodiments may be used with any one of the others, within the scope of the inventive concept.

I claim:

1. Ignition coil for an internal combustion engine providing ignition pulses with a sharply rising flank having an iron core (1) of approximately square cross section, a primary winding (2) and a secondary winding (3);

one of the windings (2) being a square coil of approximately square cross section and surrounding the iron core (1), the other winding (3) being a cylindrical coil of essentially circular cross section and surrounding the first winding (2) so that a sector-shaped space (10) will be included between the outer circumference of the first, square cross section winding and the second, circular cross section winding;

and an insert of magnetic material **(8*a*, 8*b*, 8*c*, 8*d*) located within said essentially sector-shaped space (10), between the primary (2) and the secondary (3) windings and essentially filling the space (10) between the windings, said magnetic insert forming a magnetic shunt with respect to the core to modify the wave form of pulses induced in the secondary winding (3) upon interruption of current flow through the primary winding (2)** and providing pulses having a sharply rising flank.

2. Ignition coil according to claim 1, wherein the first coil of essentially square cross section forms the primary winding (2) and the second coil of essentially cylindrical form forms the secondary winding (3).

3. Ignition coil according to claim 1, wherein (FIGS. **1*a*, 2*a*) the insert of magnetic material (8*a*) comprises at least one wire (13)** extending coaxially with respect to the windings.

4. Ignition coil according to claim 1, wherein (FIGS. **1*a*, 2 *a*) the insert (8*a*) of magnetic material comprises a bundle of wires (13)** extending approximately axially with respect to the windings and adjacent said windings in the space between the outer circumference of the winding surrounding the core and the inner circumference of the outer one of the windings.

5. Ignition coil according to claim 1. wherein (FIGS. **1*b*, 2*b*) the insert (8*b*) of magnetic material comprises at least one strip (12) extending longitudinally with respect to the windings (2, 3)**.

6. Ignition coil according to claim 1, wherein (FIGS. **2*c*, 2*d*) the insert (8*c*, 8*d*)** of magnetic material comprises particles of magnetically conductive material embedded in a potting compound.

7. Ignition coil according to claim 1, wherein the insert **(8*a*, 8*b*) of magnetically conductive material comprises elongated magnetic elements extending beyond the end face of the windings (2, 3)**.

8. Ignition coil according to claim 1, wherein the insert of magnetically conductive materials comprises soft iron.

9. Ignition coil according to claim 1, wherein the core (1) comprises three legs (17, 18, 19) and two return yokes (15, 16 ), the center leg (18) of the core being surrounded by the primary winding (2) and by the secondary winding (3) of the coil.

10. Ignition coil according to claim 1, wherein a potting compound surrounds the primary winding (2), the secondary winding (3) and the insert (8) of magnetically conductive material to form a single unitary structural element.

11. Ignition coil according to claim 10, wherein the potting compound comprises resin material.

* * * * *

UNITED STATES PATENT AND TRADEMARK OFFICE

CERTIFICATE OF CORRECTION

PATENT NO. : 4,048,972

DATED : September 20, 1977

INVENTOR(S) : Paul WÖRZ

It is certified that error appears in the above-identified patent and that said Letters Patent are hereby corrected as shown below:

The Title Page should be deleted and substituted with the attached sheet therefor.

Signed and Sealed this

*Fourth* Day of *April 1978*

[SEAL]

*Attest:*

RUTH C. MASON
*Attesting Officer*

LUTRELLE F. PARKER
*Acting Commissioner of Patents and Trademarks*

United States Patent [19]

Wörz

[11] 4,048,972

[45] Sept. 20, 1977

[54] IGNITION COIL FOR INTERNAL COMBUSTION ENGINES

[75] Inventor: Paul Wörz, Schwieberdingen, Germany

[73] Assignee: Robert Bosch GmbH, Stuttgart, Germany

[21] Appl. No.: 618,556

[22] Filed: Oct. 1, 1975

[30] Foreign Application Priority Data

Oct. 12, 1974 Germany ..... 2448768

[51] Int. Cl.² ..... F02P 7/00

[52] U.S. Cl. ..... 123/148 D; 336/96; 336/160

[58] Field of Search ..... 123/148 D; 336/69, 160, 336/228

[56] References Cited

U.S. PATENT DOCUMENTS

| | | | |
|---|---|---|---|
| 1,159,226 | 11/1915 | Johannesen | 336/160 |
| 2,081,979 | 6/1937 | Bentley | 123/148 D |
| 2,850,708 | 9/1958 | Antalis | 336/160 X |
| 3,617,966 | 11/1971 | Trench | 336/96 X |
| 3,795,236 | 3/1974 | Jukes | 336/96 X |
| 3,949,338 | 4/1976 | Burson | 336/96 X |

*Primary Examiner*—Harold W. Weakley
*Attorney, Agent, or Firm*—Flynn & Frishauf

[57] ABSTRACT

To provide a sharply rising flank of the ignition pulse, an insert of ferromagnetic material is placed between the primary and secondary coils of the primary and secondary windings of the ignition coil, forming a magnetic shunt to the core, and modifying the wave form of the output pulse from the ignition coil upon sudden interruption of current flow therethrough.

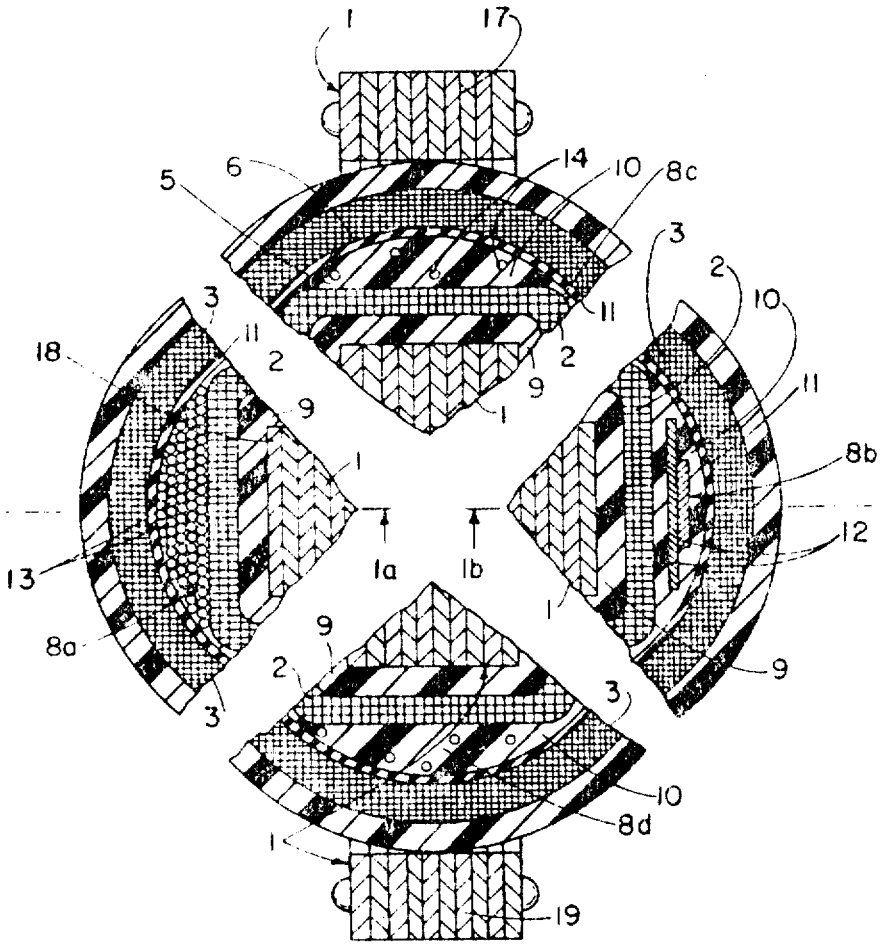

11 Claims, 6 Drawing Figures